US011674379B2

(12) United States Patent
Al Saad et al.

(10) Patent No.: US 11,674,379 B2
(45) Date of Patent: Jun. 13, 2023

(54) METHOD AND SYSTEM FOR MANAGING GAS SUPPLIES

(71) Applicant: SAUDI ARABIAN OIL COMPANY, Dhahran (SA)

(72) Inventors: Mohammed S. Al Saad, AlKawthar (SA); Adel Al-Qahtani, Al Khubar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 97 days.

(21) Appl. No.: 17/198,845

(22) Filed: Mar. 11, 2021

(65) Prior Publication Data

US 2022/0290554 A1 Sep. 15, 2022

(51) Int. Cl.

| | |
|---|---|
| ***E21B 47/047*** | (2012.01) |
| ***E21B 47/06*** | (2012.01) |
| ***E21B 47/10*** | (2012.01) |

(52) U.S. Cl.

CPC ..... *E21B 47/047* (2020.05); *E21B 47/06* (2013.01); *E21B 47/10* (2013.01); *E21B 2200/20* (2020.05)

(58) Field of Classification Search

CPC ..... E21B 47/047; E21B 47/06; E21B 47/10; E21B 2200/20

See application file for complete search history.

(56) References Cited

U.S. PATENT DOCUMENTS 4,505,155 A * 3/1985 Jackson ..... E21B 47/06 73/714
5,885,478 A * 3/1999 Montgomery ..... C04B 18/16 252/175

(Continued)

FOREIGN PATENT DOCUMENTS

| | | | |
|---|---|---|---|
| AU | 2007265695 | B2 | 5/2012 |
| CN | 202832488 | U | 3/2013 |
| CN | 103616865 | A | 3/2014 |
| CN | 104832156 | A | 8/2015 |

(Continued)

OTHER PUBLICATIONS

Al-Saad, Bader et al., "Development and Implementation of the AVAILS+ Collaborative Forecasting Tool for Production Assurance in the Kuwait Oil Company, North Kuwait (KOC NK)", SPE-167375-PA, SPE Economics & Management, Society of Petroleum Engineers, vol. 6, No. 4, Jul. 2014, pp. 191-198 (8 pages).

(Continued)

*Primary Examiner* — Natalie Huls
*Assistant Examiner* — Sharad Timilsina
(74) *Attorney, Agent, or Firm* — Osha Bergman Watanabe & Burton LLP

(57) ABSTRACT

A method may include obtaining gas well data regarding various gas wells. The method may further include determining various well potential values for the gas wells based on the gas well data and a predetermined production period. The method may further include determining, based on the well potential values, a reservoir pressure criterion, and a water risk criterion, an available supply rate for a respective gas well among the gas wells. The method may further apply wells congestion cycling coupled to producing reservoirs to allow for uniform depletion across gas wells. The method may further include determining a production scenario based on the available supply rate and a supply target. The method may further include transmitting a command that implements a gas supply adjustment at a gas plant based on the production scenario.

17 Claims, 7 Drawing Sheets

(56) References Cited

U.S. PATENT DOCUMENTS

| | | | | |
|---|---|---|---|---|
| 6,980,940 | B1 | 12/2005 | Gurpinar et al. | |
| 7,369,979 | B1 | 5/2008 | Spivey | |
| 2005/0149307 | A1* | 7/2005 | Gurpinar | E21B 43/00 703/10 |
| 2009/0084545 | A1 | 4/2009 | Banerjee et al. | |
| 2009/0276156 | A1 | 11/2009 | Kragas et al. | |
| 2013/0268247 | A1 | 10/2013 | Rowan et al. | |
| 2014/0251613 | A1* | 9/2014 | Hill, Jr. | E21B 34/06 166/373 |
| 2014/0365409 | A1 | 12/2014 | Burch et al. | |
| 2016/0180357 | A1* | 6/2016 | Collum, Jr. | G06Q 30/0202 705/7.31 |
| 2016/0356125 | A1* | 12/2016 | Bello | E21B 43/14 |
| 2018/0202264 | A1 | 7/2018 | Sarduy et al. | |
| 2019/0226308 | A1* | 7/2019 | Konopczynski | E21B 33/12 |
| 2019/0249547 | A1 | 8/2019 | Li et al. | |
| 2019/0277115 | A1 | 9/2019 | Kibsgaard et al. | |
| 2019/0284926 | A1 | 9/2019 | Tiss et al. | |
| 2020/0199987 | A1 | 6/2020 | Steele et al. | |
| 2020/0362674 | A1 | 11/2020 | Manazi et al. | |
| 2021/0222552 | A1* | 7/2021 | Gao | E21B 43/00 |

FOREIGN PATENT DOCUMENTS

| | | | |
|---|---|---|---|
| CN | 110969307 | A | 4/2020 |
| CN | 112049625 | A | 12/2020 |
| WO | 2020025998 | A1 | 2/2020 |

OTHER PUBLICATIONS

Cogan, Jess D., "The Removal of Barium, Strontium, Calcium and Magnesium from Hydraulic Fracturing Produced Water Using Precipitation with Traditional and Alternative Reactant Feedstocks", Voinovich School of Leadership & Public Affairs, Apr. 2016 (87 pages).

Dunham, Cleon L., "Production Automation in the 21st Century: Opportunities for Production Optimization and Remote Unattended Operations", SPE-79390-JPT, Journal of Petroleum Technology, Society of Petroleum Engineers, vol. 55, No. 7, Jul. 2003, pp. 68-73 (6 pages).

International Search Report and Written Opinion issued in corresponding International Patent Application No. PCT/US2022/019787, dated Jun. 3, 2022 (13 pages).

* cited by examiner

METHOD AND SYSTEM FOR MANAGING GAS SUPPLIES

BACKGROUND

Natural gas wells may include wells that do not produce oil but only raw natural gas or condensate wells that produce both gas and natural gas condensate (i.e., wet gas). For many condensate wells, a gas-liquid mixture at the well may pass through a field separator to remove condensate and water. The natural gas liquids separated at this stage may be transported to a gas plant accordingly. Other times, a mixed stream of gas, water, and/or oil may be transported to a gas plant for further processing.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method that includes obtaining, by a computer processor, gas well data regarding various gas wells. The method further includes determining, by the computer processor, various well potential values for the gas wells based on the gas well data and a predetermined production period. The method further includes determining, by the computer processor and based on the well potential values, a reservoir pressure criterion, and a water risk criterion, an available supply rate for a respective gas well among the gas wells. The method further includes determining, by the computer processor, a production scenario based on the available supply rate and a supply target. The method further includes transmitting, by the computer processor, a command that implements a gas supply adjustment at a gas plant based on the production scenario.

In general, in one aspect, embodiments relate to a system that include gas wells that include pressure sensors that detect flowing wellhead pressure (FWHP) data. The system further includes a gathering system coupled to the gas wells, where the gathering system includes remote headers that control streams from the gas wells. The system further includes a gas supply manager that includes a computer processor and is coupled to the gas wells and the gathering system. The gas supply manager obtains gas well data regarding gas wells. The gas supply manager further determines various well potential values for the gas wells based on the gas well data and a predetermined production period. The gas supply manager further determines, based on the well potential values, a reservoir pressure criterion, and a water risk criterion, an available supply rate for a respective gas well among the gas wells. The gas supply manager further determines a production scenario based on the available supply rate and a supply target. The gas supply manager transmits a command that implements a gas supply adjustment at one or more gas plants based on the production scenario.

In general, in one aspect, embodiments relate to a non-transitory computer readable medium storing instructions executable by a computer processor. The instructions obtain gas well data regarding various gas wells. The instructions further determine various well potential values for the gas wells based on the gas well data and a predetermined production period. The instructions further determine, based on the well potential values, a reservoir pressure criterion and a water risk criterion, an available supply rate for a respective gas well among the plurality of gas wells. The instructions further determine a production scenario based on the available supply rate and a supply target. The instructions further transmit a command that implements a gas supply adjustment at a gas plant based on the production scenario.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
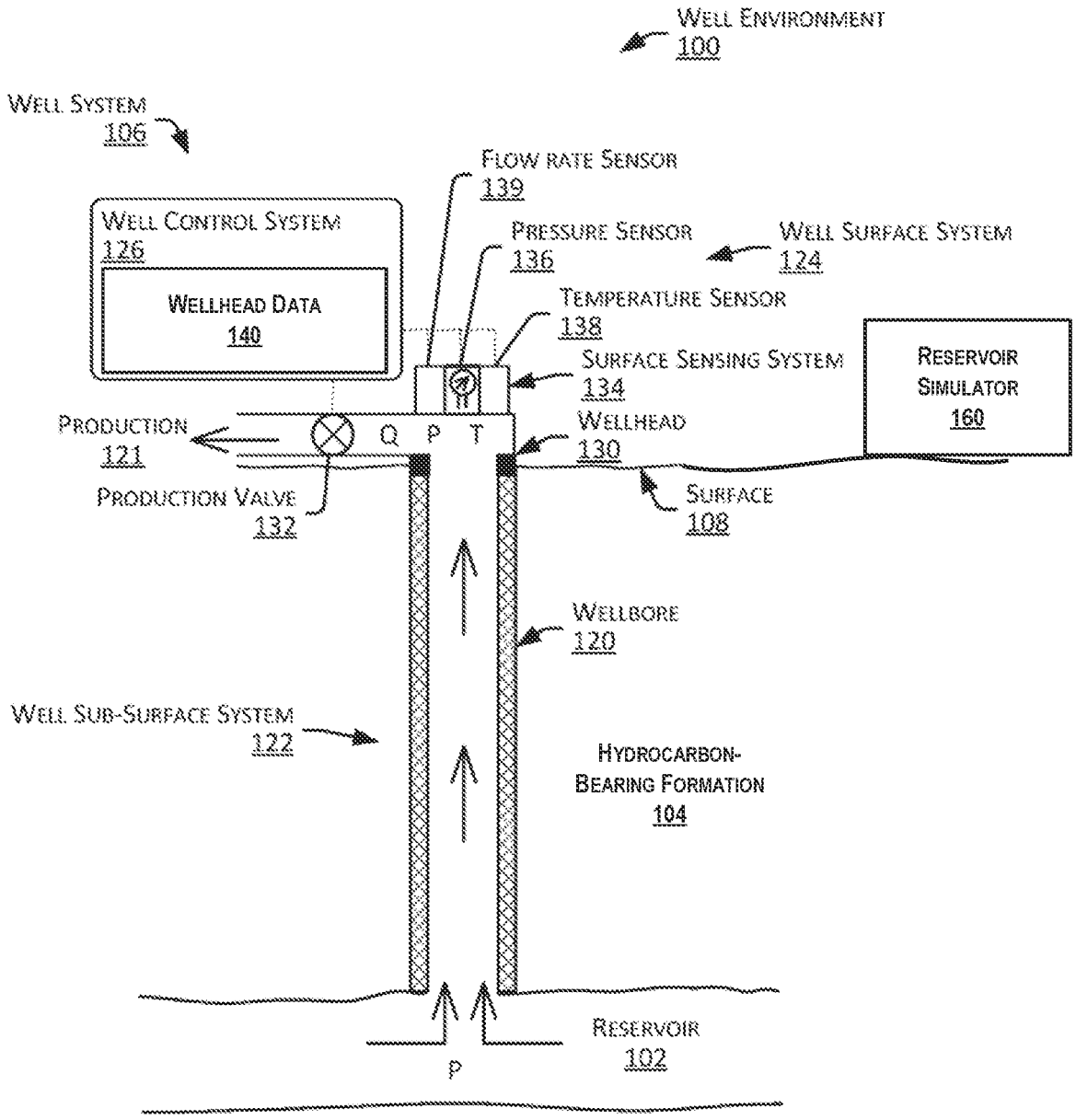
FIGS. 1, 2, and 3A-3B show systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for determining various supply rates and production scenarios within a gas network. In some embodiments, a gas well corresponds to a well potential value that is a function of reservoir pressure, a productivity index, a specified production period, and a tested maximum gas supply rate of the gas well. Where all else is equal, the well potential value may describe the possible gas supply rate for a given gas well. However, this well potential value may not correspond to the available gas supply actually provided by the well. More specifically, other factors may influence a well's available supply, such as a how different supply rates affect a reservoir's health or congestion factors associated other nearby gas wells. Likewise, the long-term effects of implementing a particular gas supply rate may be considered when implementing an available supply rate at the well. Likewise, the available gas supply of a well may be influenced by a water assessment regarding different supply rates. For example, increasing a gas supply rate may also increase the water risk that larger concentrations chloride and strontium occur in a water supply. Moreover, an actual production scenario for multiple gas wells may include multiple constraints based on congestion cycling criteria, surface facility criteria, stream prioritization with respect to a gas plant, and various supply demands.

In some embodiments, a gas supply manager is used within a gas supply network to determine available gas supplies as well as production scenarios based on supply and demand. For example, a gas supply manager may in seconds incorporate gas well data from multiple gas wells, gas plant data from multiple gas plants, and various dynamics in order to simulate possible production scenarios. For example, gas well data may include testing data (e.g., the maximum gas supply rate shown in well tests), water sampling data, solid production data, condensate data (e.g., the condensate yield at a particular well), congestion cycle data, well locations, and producing reservoir data.

Furthermore, production scenarios may be generated according to various time-bases, such as yearly, monthly, or even daily. Thus, some embodiments may manage congested well areas (e.g., for wells within 1 km of each other) as well as solids and produced water resulting from gas production. Likewise, some embodiments may manage available gas supplies for a single reservoir, a multi-reservoir field, and/or multiple gas fields. Thus, some embodiments may eliminate subjectivity in determining and implementing different production scenarios through increased automation. Accordingly, some embodiments may determine production scenarios in an instantaneous and sustainable manner that meet gas demands while maintaining health of reservoirs and facility integrity.

Turning to FIG. 1, FIG. 1 shows a schematic diagram in accordance with one or more embodiments. As shown in FIG. 1, FIG. 1 illustrates a well environment (100) that includes a hydrocarbon reservoir ("reservoir") (102) located in a subsurface hydrocarbon-bearing formation (104) and a well system (106). The hydrocarbon-bearing formation (104) may include a porous or fractured rock formation that resides underground, beneath the earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock having varying characteristics, such as varying degrees of permeability, porosity, and resistivity. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), and a well control system (126). The control system (126) may control various operations of the well system (106), such as well production operations, well completion operations, well maintenance operations, and reservoir monitoring, assessment and development operations. In some embodiments, the control system (126) includes a computer system that is the same as or similar to that of computer system (602) described below in FIG. 6 and the accompanying description.

The wellbore (120) may include a bored hole that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "down-hole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) into the hydrocarbon-bearing formation (104) or the reservoir (102) during monitoring operations (e.g., during in situ logging operations).

In some embodiments, during operation of the well system (106), the control system (126) collects and records wellhead data (140) for the well system (106). The wellhead data (140) may include, for example, a record of measurements of wellhead pressure (P) (e.g., including flowing wellhead pressure (FWHP)), wellhead temperature (T) (e.g., including flowing wellhead temperature), wellhead production rate (Q) over some or all of the life of the well (106), and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well (106) to assess a relatively current state of the well system (106), and make real-time decisions regarding development of the well system (106) and the reservoir (102), such as on-demand adjustments in regulation of production flow from the well.

With respect to water cut data, the well system (106) may include one or more water cut sensors. For example, a water cut sensor may be hardware and/or software with functionality for determining the water content in oil, also referred to as "water cut." Measurements from a water cut sensor may be referred to as water cut data and may describe the ratio of water produced from the wellbore (120) compared to the total volume of liquids produced from the wellbore (120). Water cut sensors may implement various water cut measuring techniques, such as those based on capacitance measurements, Coriolis effect, infrared (IR) spectroscopy, gamma ray spectroscopy, and microwave technology. Water cut data may be obtained during production operations to determine various fluid rates found in production from the well system (106). This water cut data may be used to determine water-to-gas information regarding the wellhead (130).

In some embodiments, a water-to-gas ratio (WGR) is determined using a multiphase flow meter. For example, a multiphase flow meter may use magnetic resonance information to determine the number of hydrogen atoms in a particular fluid flow. Since oil, gas and water all contain hydrogen atoms, a multiphase flow may be measured using magnetic resonance. In particular, a fluid may be magnetized and subsequently excited by radio frequency pulses. The hydrogen atoms may respond to the pulses and emit echoes that are subsequently recorded and analyzed by the multiphase flow meter.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (134). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

Keeping with FIG. 1, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature and flow rate of production (121) flowing through the wellhead (130), or other conduits of the well surface system (124), after exiting the wellbore (120).

In some embodiments, the surface sensing system (134) includes a surface pressure sensor (136) operable to sense the pressure of production (151) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (151) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" (T). In some embodiments, the surface sensing system (134) includes a flow rate sensor (139) operable to sense the flow rate of production (151) flowing through the well surface system (124), after it exits the wellbore (120). The flow rate sensor (139) may include hardware that senses a flow rate of production (121) (Q) passing through the wellhead (130).

In some embodiments, the well system (106) includes a reservoir simulator (160). For example, the reservoir simulator (160) may include hardware and/or software with functionality for generating one or more reservoir models regarding the hydrocarbon-bearing formation (104) and/or performing one or more reservoir simulations. For example, the reservoir simulator (160) may store well logs and data regarding core samples for performing simulations. A reservoir simulator may further analyze the well log data, the core sample data, seismic data, and/or other types of data to generate and/or update the one or more reservoir models. While the reservoir simulator (160) is shown at a well site, embodiments are contemplated where reservoir simulators are located away from well sites. In some embodiments, the reservoir simulator (160) may include a computer system that is similar to the computer system (602) described below with regard to FIG. 6 and the accompanying description.

Figure 2:
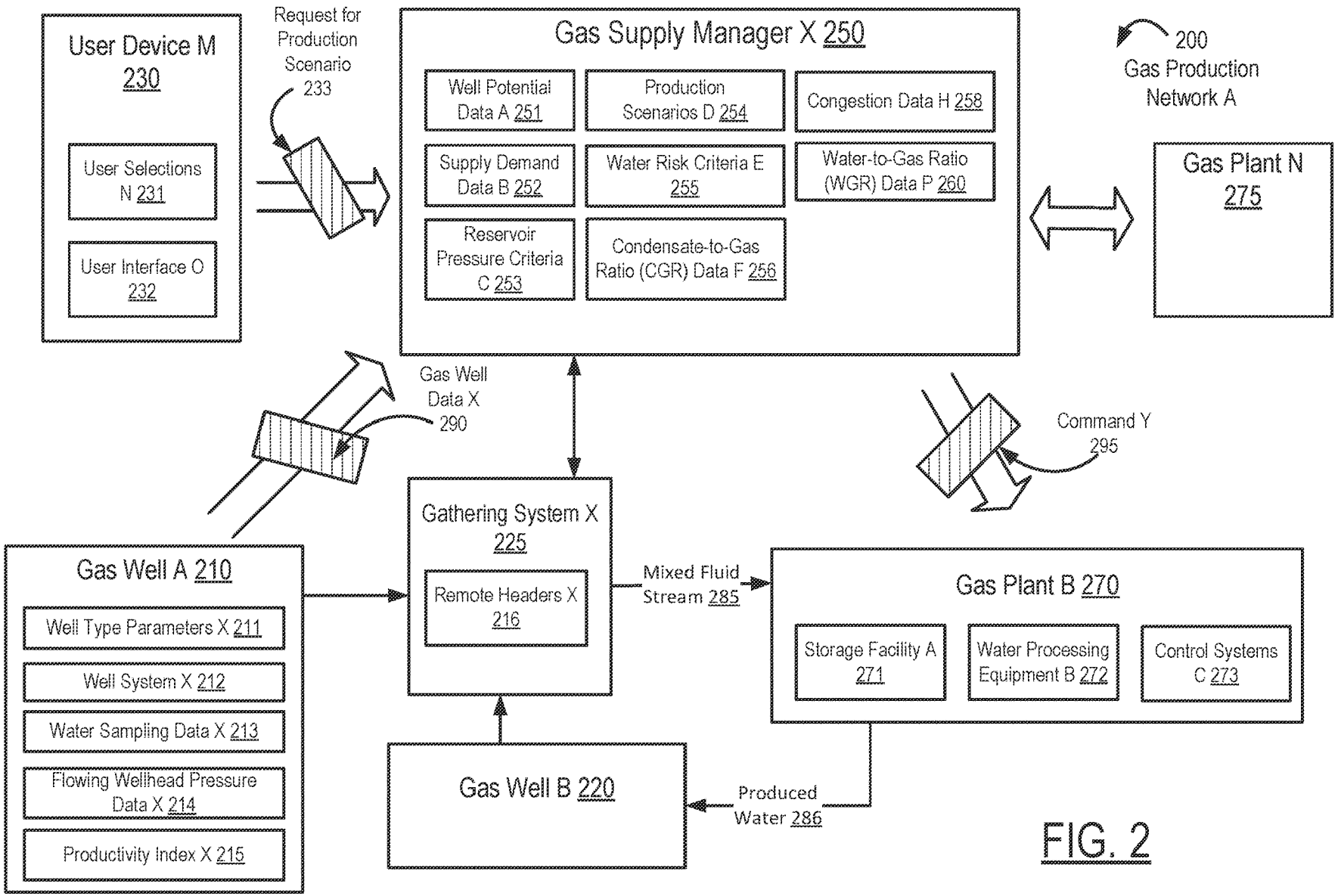

Turning to FIG. 2, FIG. 2 shows a schematic diagram in accordance with one or more embodiments. As shown in FIG. 2, a gas production network (e.g., gas production network A (200)) may include various gas wells (e.g., gas well A (210), gas well B (220)), various gas plants (e.g., gas plant B (270), gas plant N (275)), and various user devices (e.g., user device M (230)), various control systems (e.g., control systems C (273)), various network elements (not shown), and/or a gas supply manager (e.g., gas supply manager X (250)). A gas well may include a well system (e.g., well system X (212)) that is similar to well system (106) described above in FIG. 1 and the accompanying description. In some embodiments, various types of gas well data (e.g., gas well data X (290)) are collected over the gas production network, such as water sampling data (e.g., water sampling data X (213)), flowing wellhead pressure data (e.g., flowing wellhead pressure data X (214)), productivity index information (e.g., productivity index X (215)). Likewise, the gas production network may also collect various well type parameters (e.g., well type parameters X (211)) that describe various gas well characteristics, such as reservoir type, completion type, and surface facility conditions.

In some embodiments, one or more gas wells are coupled to a gathering system (e.g., gathering system X (225)). A gathering system (also referred to as a collecting system or gathering facility) may include various hardware arrangements that connect flowlines from several gas wells into a single gathering line. For example, a gathering system may include flowline networks, headers, pumping facilities, separators, emulsion treaters, compressors, dehydrators, tanks, valves, regulators, and/or associated equipment. In particular, a remote header (e.g., remote headers X (216)) may have production valves and testing valves to control a mixed stream for a flowline of a respective gas well. Thus, a gathering system may direct various hydrocarbon fluids to a processing or testing facility, such as a gas plant. In some embodiments, a gathering system manages individual fluid ratios (e.g., a particular gas-to-water ratio or condensate-to-gas ratio) as well as supply rates of oil, gas, and water. For example, a gathering system may assign a particular production value or ratio value to a particular gas well by opening and closing selected valves among the remote headers and using individual metering equipment or separators. Furthermore, a gathering system may be a radial system or a trunk line system. A radial system may bring various flowlines to a single central header. In contrast, a trunk-line system may use several remote headers to collect oil and gas from fields that cover a large geographic area. Once collected, the gathering system may transport and control the flow of oil or gas to a storage facility, a gas processing plant, or a shipping point.

Keeping with FIG. 2, gas may be transported from one or more gas wells (e.g., gas well A (210)) to one or more gas plants (e.g., gas plant B (270)), such as through one or more mixed fluid streams (e.g., mix fluid stream (285)). More specifically, a gas plant may refer to various types of industrial plants such as a gas processing plant, a gas cycling plant, or a compressor plant. A gas processing plant (also referred to as a natural gas processing plant) may be a facility that processes natural gas to recover natural gas liquids (e.g., condensate, natural gasoline, and liquefied petroleum gas) and sometimes other substances such as sulfur. A gas cycling plant may refer to an oilfield installation coupled to a gas-condensate reservoir. In particular, a gas cycling plant may extract various liquids from natural gas. Consequently, the remaining dry gas may be compressed prior to return to a producing formation, e.g., to maintain reservoir pressure. Moreover, various components of natural gas may be classified according to their vapor pressures, such as low pressure liquid (i.e., condensate), intermediate pressure liquid (i.e., natural gasoline), and high pressure liquid (i.e., liquefied petroleum gas). Examples of natural gas liquids include propane, butane, pentane, hexane, and heptane. With respect to compressor plants, a compressor plant may be a facility that includes multiple compressors, auxiliary treatment equipment, and pipeline installations for pumping natural gas over long distances. A compressor station may also repressurize gas in large gas pipelines or to link offshore gas fields to their final terminals.

Keeping with gas plants, a gas plant may include water processing equipment (e.g., water processing equipment B (272)) that includes hardware and/or software for extracting, treating, and/or disposing of water associated with gas processing. More specifically, a gas plant may extract produced water (e.g., produced water (286)) during the separation of oil or gas from a mixed fluid stream (e.g., mixed fluid stream (285)) acquired from a gas well. This produced water may be a kind of brackish and saline water brought to the surface from underground formations. In particular, oil and gas reservoirs may have water in addition to hydrocarbons in various zones underneath the hydrocarbons, and even in the same zone as the oil and gas. However, most produced water is of very poor quality and may include high levels of natural salts and minerals that have dissociated from geological formations in the target reservoir. Likewise, produced water may also acquire dissolved constituents from fracturing fluids (e.g., substances added to the fracturing fluid to help prevent pipe corrosion, minimize friction, and aid the fracking process). However, through various water treatments, produced water may be reused in one or more gas wells, e.g., through waterflooding where produced water is injected into the reservoirs. By injecting produced water into an injection well, the injected water may force oil and gas to one or more production wells.

Keeping with produced water, a gas plant may use various treatment technologies in order to reuse or dispose of produced water, such as conventional treatments and advanced treatments. For example, conventional treatments may include flocculation, coagulation, sedimentation, filtration, and lime softening water treatment processes. Thus, conventional treatment processes may include functionality for removing suspended solids, oil and grease, hardness compounds, and other nondissolved water components. With advanced treatment technologies, water processing equipment may include functionality for performing reverse osmosis membranes, thermal distillation, evaporation and/or crystallization processes. These advanced treatment technologies may treat dissolved solids, such as chlorides, salts, barium, strontium and sometimes dissolved radionuclides. In some embodiments, produced water is sent to a wastewater treatment plant that is equipped to remove barium and strontium, e.g., using sulfate precipitation. Outside of treatments for reusing produced water, water processing equipment may dispose of produced water using various water management options. For example, produced water may be disposed in salt water wells. Likewise, produced water may also be eliminated through a deep well injection.

In some embodiments, a gas plant may include one or more storage facilities (e.g., storage facility A (271)) and one or more control systems (e.g., control systems C (273)). For example, different forms of gas may be stored in various storage facilities that include surface containers as well as various underground reservoirs, such as depleted gas reservoirs, aquifer reservoirs and salt cavern reservoirs. With respect to control systems, a control system may include hardware and/or software that monitors and/or operates equipment, such as at a gas well or in a gas plant. Examples of control systems may include one or more of the following: an emergency shut down (ESD) system, a safety control system, a video management system (VMS), process analyzers, other industrial systems, etc. In particular, a control system may include a programmable logic controller that may control valve states, fluid levels, pipe pressures, warning alarms, pressure releases and/or various hardware components throughout a facility. Thus, a programmable logic controller may be a ruggedized computer system with functionality to withstand vibrations, extreme temperatures, wet conditions, and/or dusty conditions, such as those around a refinery or drilling rig.

With respect to distributed control systems, a distributed control system may be a computer system for managing various processes at a facility using multiple control loops. As such, a distributed control system may include various autonomous controllers (such as remote terminal units) positioned at different locations throughout the facility to manage operations and monitor processes. Likewise, a distributed control system may include no single centralized computer for managing control loops and other operations. On the other hand, a SCADA system may include a control system that includes functionality for enabling monitoring and issuing of process commands through local control at a facility as well as remote control outside the facility. With respect to an RTU, an RTU may include hardware and/or software, such as a microprocessor, that connects sensors and/or actuators using network connections to perform various processes in the automation system.

Keeping with control systems, a control system may be coupled to facility equipment. Facility equipment may include various machinery such as one or more hardware components that may be monitored using one or more sensors. Examples of hardware components coupled to a control system may include crude oil preheaters, heat exchangers, pumps, valves, compressors, loading racks, and storage tanks among various other types of hardware components. Hardware components may also include various network elements or control elements for implementing control systems, such as switches, routers, hubs, PLCs, remote terminal units, user equipment, or any other technical components for performing specialized processes. Examples of sensors may include pressure sensors, torque sensors, rotary switches, weight sensors, position sensors, microswitches, hydrophones, accelerometers, etc. A gas supply manager, user devices, and network elements may be computer systems similar to the computer system (602) described in FIG. 6 and the accompanying description.

In some embodiments, a gas production network includes a gas supply manager (e.g., gas supply manager) that includes hardware and/or software for collecting data in real-time from various gas wells, gas plants, user devices, and other systems in the gas network. More specifically, a gas supply manager may include functionality for obtaining data throughout the gas production network, such as gas well data (e.g., gas well data X (290)). For example, gas well data may include testing data of potential gas rates, flowing wellhead pressure (FWHP), water-gas ratio (WGR) data, condensate data such as condensate-gas ratio (CGR) data, productivity index (PI) data, water sampling data (e.g., levels of Chloride and Strontium concentrations), and congestion data regarding congestion cycles of gas wells. The gas supply manager may also collect various well type parameters (e.g., well type parameters X (211)) regarding various gas wells, such as reservoir type, completion type, and remote header information regarding the gathering system coupled to the gas wells.

In some embodiments, a gas supply manager includes functionality for determining and/or implementing one or more production scenarios (e.g., production scenarios D (254)) in real-time based on gas well data, well type parameters, and/or gas plant data. In particular, a production scenario may allocate different supply rates (e.g., by assigning a maximum production rate for a particular well) to different gas wells, different reservoirs, and/or different fields. As such, a gas supply manager may analyze multiple gas wells to cluster the gas wells based on various well parameters, real-time well potentials (e.g., well potential data A (251)), congestion cycling (e.g., congestion data H (258)), peak summer production (PSP) automation, and/or different production scenarios. Moreover, the gas supply manager may determine well potential values for individual gas wells, as well as field potential values based on well potentials for multiple wells in a single field. Thus, the gas supply manager may automatically prioritize production instantaneously by incorporating various time-dependent gas and condensate demand scenarios into a production scenario. For example, the gas supply manager may analyze many aspects related to well production dynamics such as well productivity, supply demands (e.g., supply demand data B (252)), condensate yields (e.g., condensate-to-gas ratio data F (256)), water analysis (e.g., water-to-gas ratio data P (260)), solids production, as well as congestion cycles. Thus, the gas supply manager automatically generates and implements a production scenario as well as implement prioritization among various gas wells. In some embodiments, a gas supply manager includes functionality for generating periodic production scenarios, such as monthly scenarios.

In some embodiments, a user device (e.g., user device M (230)) may communicate with the gas supply manager to adjust dynamically a particular production scenario based on one or more user selections (e.g., user selections N (231)). The user device may be a personal computer, a handheld computer device such as a smartphone or personal digital assistant, or a human machine interface (HMI). For example, a user may interact with a user interface (e.g., user interface O (232)) to change a time interval of a production period, the amount of solids and produced water mitigated in a production scenario, scenario parameters to maintain reservoir health, and amounts of water encroachment in a reservoir. Through user selections or automation, the gas supply manager may maintain well performance health, manage production in congested areas, and raise supply dynamic awareness by presenting well clusters and associated information in a graphical user interface. As such, a gas supply manager may provide agility and flexibility in determining and modifying production scenarios.

In some embodiments, a production scenario is generated by a gas supply manager upon obtaining a request (e.g., request for production scenario (233)) from a user device and using various predetermined criteria (e.g., reservoir pressure criteria C (253), water risk criteria E (255)). The request may be a network message transmitted between a user device and a gas supply manager that identifies various gas wells, gas plants, gathering systems, a predetermined time frame, and other parameters for a requested production scenario. In some embodiments, the gas supply manager includes functionality for transmitting commands (e.g., command Y (295)) to one or more control systems to implement a particular production scenario. For example, the gas supply manager X (250) may transmit a network message over a machine-to-machine protocol to the well system X (212) in gas well A (210) or one or more of control systems C (273) in gas plant B (270). A command may be transmitted periodically, based on a user input, or automatically based on changes in gas well data or gas plant data.

Figure 3A:
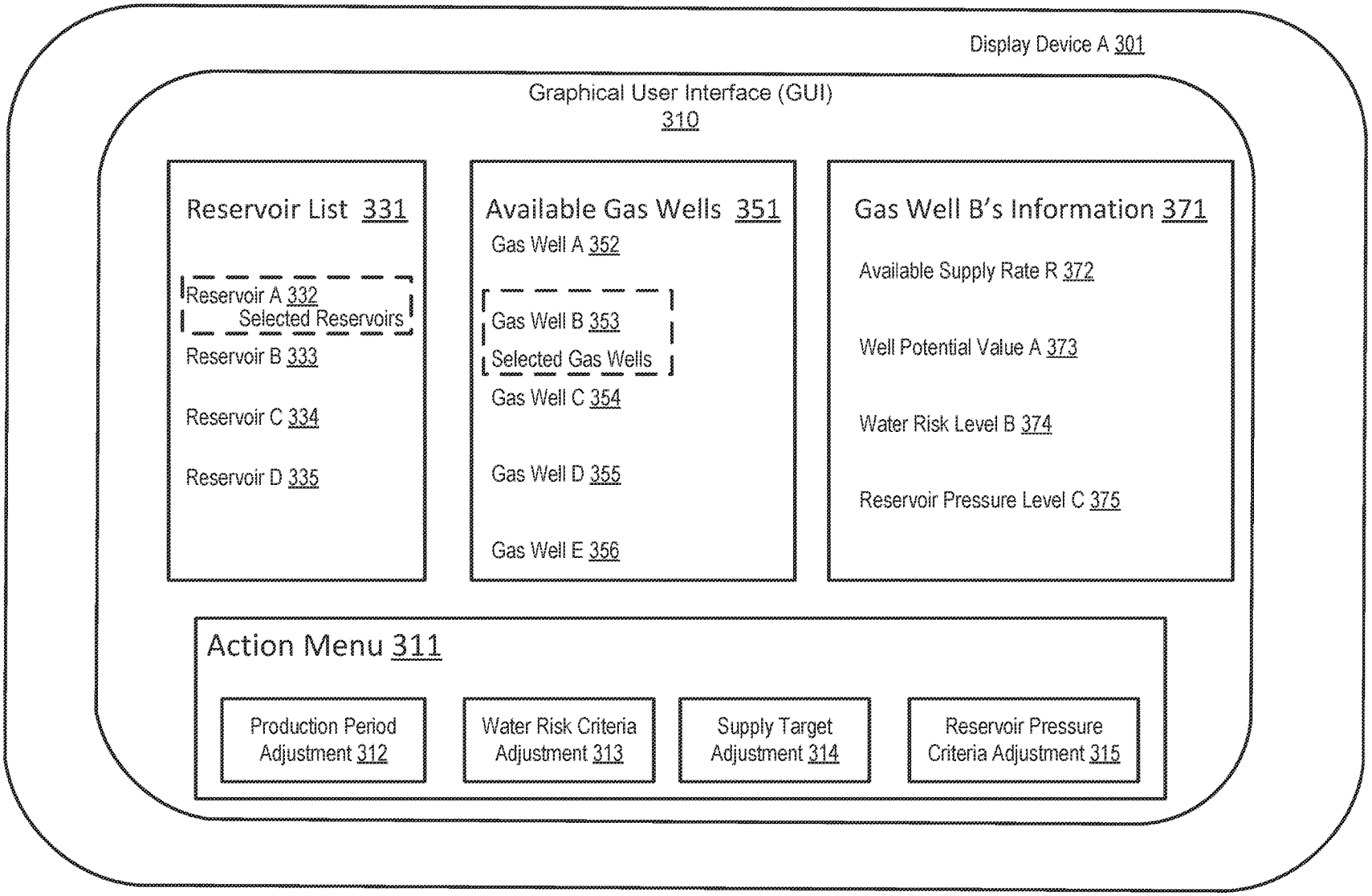
Figure 3B:
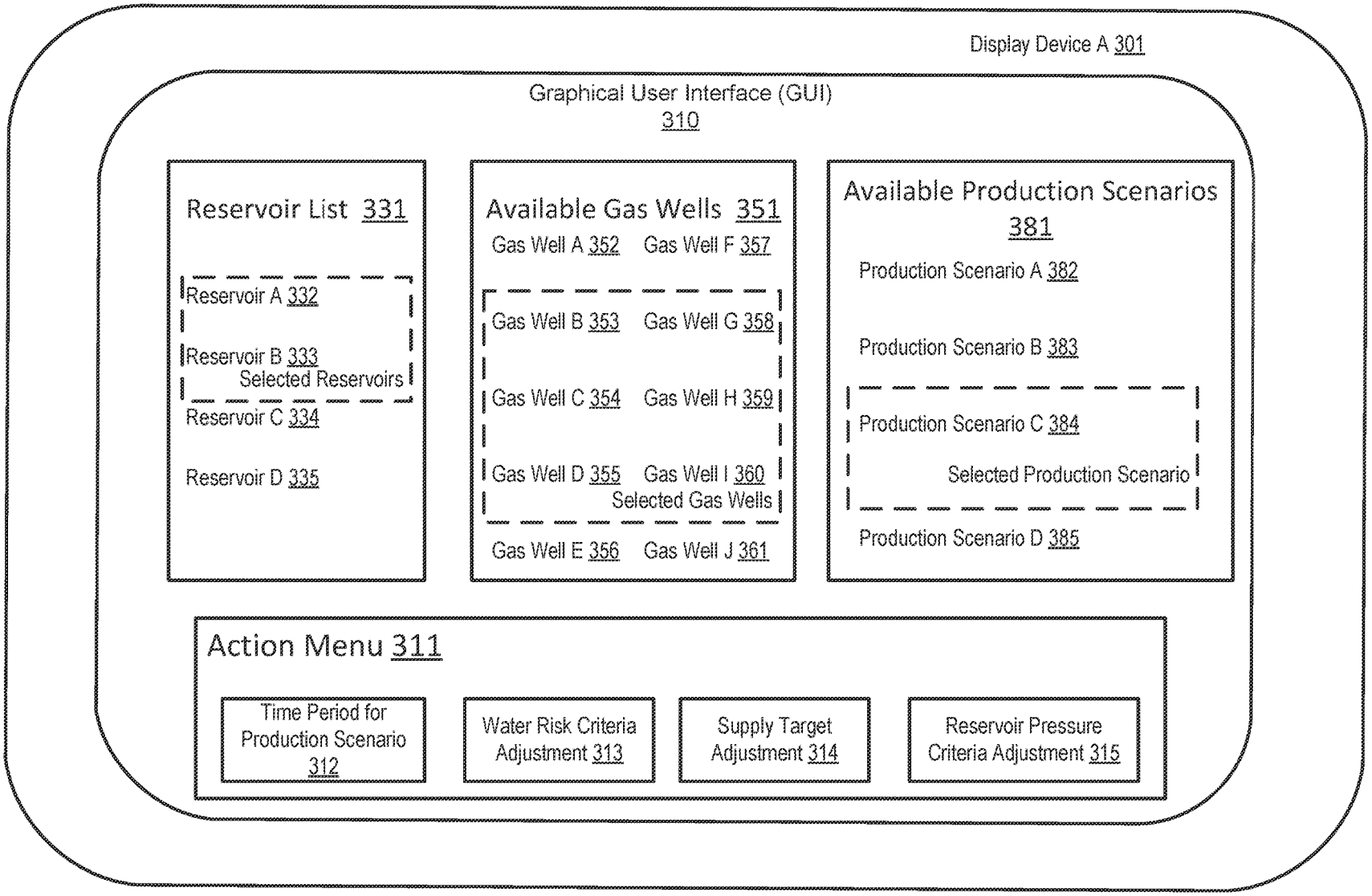

Turning to FIGS. 3A-3B, FIGS. 3A-3B illustrate an example of managing various gas wells and available gas supplies using a user interface in accordance with one or more embodiments. In FIG. 3A, a graphical user interface (GUI) (310) may be provided by a gas supply manager using a display device A (301) of a user device (not shown). Here, the GUI (310) may provide information regarding various reservoirs (i.e., a reservoir list (331)) that includes a reservoir A (332), a reservoir B (333), a reservoir C (334), and a reservoir D (335)) as well as available gas wells (351) based on the reservoir selection. For example, a user may select reservoir A (332), which subsequently populates the available gas wells (351) with various gas wells coupled to reservoir A (332) (i.e., gas well A (352), gas well B (353), gas well C (354), gas well D (355), and gas well E (356)). The user further selects gas well B (353) causing the GUI (310) to present gas well B's information (371). With respect to gas well B (353), the GUI (310) displays an available supply rate R (372), a well potential value A (373), a water risk level B (374), and a reservoir pressure level C (375).

Keeping with FIG. 3A, in some embodiments, a gas supply manager provides an action menu (311) to a user for determining and implementing one or more production scenarios. In particular, the action menu (311) may be a GUI window that enables a user to adjust various predetermined criteria for determining available supply rates from different gas wells. For example, a user may use the selection for the production period adjustment (312) in the action menu (311) to adjust the starting date and ending date of a production period for a production scenario. Likewise, the user may also use the selection for the water risk criteria adjustment (313) to modify water risk criteria for different water risk levels and their associated gas supply rates. In another example, gas plants may have different supply demands throughout the year, and thus a user may modify the supply target for a particular production scenario using the selection for the supply target adjustment (314). In another example, the user may modify reservoir pressure values among reservoir pressure criteria (e.g., reservoir pressure criteria adjustment (315)) using the selection for the reservoir pressure criteria adjustment. In particular, the GUI (310) may provide commands to implement a selected production scenario.

Turning to FIG. 3B, a user may select two reservoirs, i.e., reservoir A (332) and reservoir B (333), for a particular production scenario. After selecting the reservoirs, the user may identify different gas wells that will contribute to the available supplies in the production scenario, i.e., gas well B (353), gas well C (354) gas well D (355), gas well G (358), gas well H (359), and gas well I (360). Thus, the user may exclude gas well A (352), gas well F (357), gas well E (356), and gas well J (361) from the production scenario, e.g., one or more of these wells may be shut-in wells for the specified production period. Based on reservoir pressure criteria, water risk criteria, and a supply target, a gas supply manager automatically generates available production scenarios (381) that satisfy the user requirements, e.g., production scenario A (382), production scenario B (383), production scenario C (384), and production scenario D (385). Accordingly, the user selects production scenario D (385).

While FIGS. 1, 2, and 3A-3B shows various configurations of components, other configurations may be used without departing from the scope of the disclosure. For example, various components in FIGS. 1, 2, and 3A-3B may be combined to create a single component. As another example, the functionality performed by a single component may be performed by two or more components.

Figure 4:
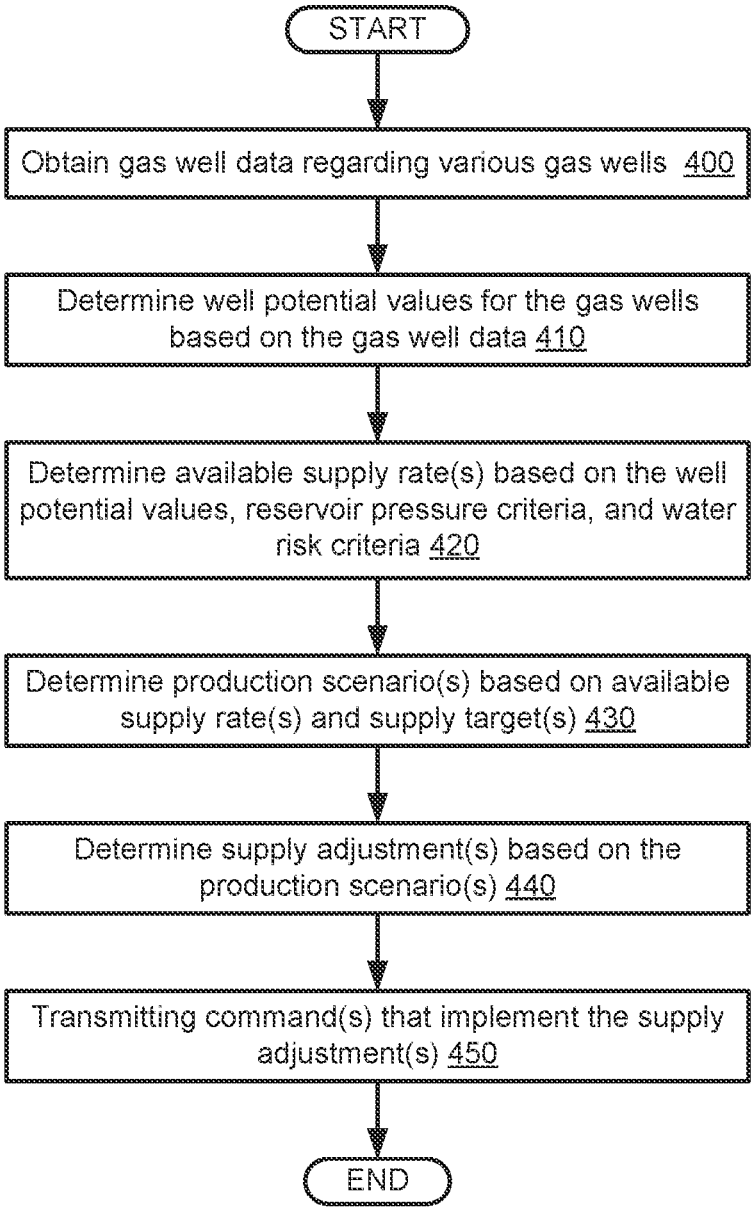
FIG. 4 shows a flowchart in accordance with one or more embodiments.

Turning to FIG. 4, FIG. 4 shows a flowchart in accordance with one or more embodiments. Specifically, FIG. 4 describes a general method for determining and/or implementing production scenarios in accordance with one or more embodiments. One or more blocks in FIG. 4 may be performed by one or more components (e.g., gas supply manager X (250)) as described in FIGS. 1, 2, and 3A-3B. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, gas well data are obtained regarding various gas wells in accordance with one or more embodiments. For example, a gas supply manager may collected various types of gas well data that may include flowing wellhead pressure (FWHP) data, water sampling data, productivity index information for the nearby geological region, tested gas rate data (e.g., the maximum gas supply rate based on measurements acquired at the gas well), etc. Likewise, the gas well data may also include condensate-to-gas ratio (CGR) data and water-to-gas ratio (WGR) data. In some embodiments, the gas supply manager may also obtain gas plant data, such as supply demand data regarding the amount of gas supply requested or predicted at one or more gas plants. In some embodiments, water-to-gas and condensate-to-gas ratio associated to each well are obtained from one or more well database tables. For example, water-to-gas data and condensate-to-gas data may be acquired from periodic separator testing performed at individual well sites.

In some embodiments, a gas supply manager uses gas well data to strategically prioritization to manage gas production network limitations. For example, gas demand dynamicity may dictate flexible gas supply generation while satisfying water and condensate handling limitations for one or more gas plants. Thus, some embodiments strategically factor in sustainability of well production to address these limitations while maintaining reservoir health to achieve an optimal strategic depletion of gas reserves.

In Block 410, various well potential values are determined for various gas wells based on gas well data in accordance with one or more embodiments. In some embodiments, well potential values correspond to one or more benchmarks against real-time gas well data (e.g., production data) from field sensors. Thus, well potential values may provide predicted gas production rate based on field type, reservoir type, and completion type. In particular, well potential values may be a function of one or more gas supply rates, one or more flowing wellhead pressures, and a productivity index.

With respect to productivity indices, a productivity index may be a measure of the maturity of a homogeneous source section in a geological region of interest coupled to a gas well. For example, a productivity index may be determined based on the quantity of free hydrocarbons (gas+oil) in the geological region and the quantity of thermally generated (e.g., cracked) hydrocarbons. As such, a productivity index less than 0.1 may be an immature geological region, a value between 0.1 and 0.3 may be a geological region usable for oil generation, and a value above 0.3 may be a geological region for natural gas generation. Further, well potential values may emulate actual production data at the corresponding gas wells. In some embodiments, well potential is determined using the following equation:

$$\text{Well Potential}=(\text{Gas Rate}\times\text{FWHP}-\text{Gas Rate}\times\text{FWHP}\times\text{Production Time Period}/\text{PI})/\text{FWHP} \quad \text{Equation 1}$$

where the well potential may correspond to a natural gas supply rate over time (e.g., as measured in a million standard cubic feet per day (MMSCFD)), gas rate corresponds to a natural gas supply rate, FWHP corresponds to flowing wellhead pressure (e.g., as measured in pounds per square in gauge (psig)), the production time period corresponds to a particular time period within a production scenario (such as a user-defined time period), and PI corresponds to a productivity index (e.g., as measured in mg/g of rock). In other words, a current well potential may be determined as a linear discounting of maximum tested potential. As such, well potential values may be tailored to different reservoir types and completion types to emulate current production potential measured on-field.

In Block 420, available supply rates are determined based on various well potential values, one or more predetermined reservoir pressure criteria, and one or more water risk criteria in accordance with one or more embodiments. For example, various systematic rules may be applied to well potential values to account for reservoir pressure conditions and water assessment constraints. For example, the reservoir pressure criteria may favor production from gas wells with higher respective reservoir pressures. In other words, reservoir pressure values may apply supply constraints to wells with lower reservoir pressures. In some embodiments, reservoir pressure criteria correspond to different predetermined reservoir pressure tiers. For example, one reservoir pressure tier may correspond to a shut-in well where the shut-in well is intended to increase reservoir pressure during a production period. Another reservoir pressure tier may correspond to a gas well that produces a maximum gas supply rate without any constraints, e.g., due to a very healthy reservoir pressure nearby. Another reservoir pressure tier may correspond to a gas well that produces a gas supply rate that is less than a maximum gas supply rate in order to preserve or increase reservoir health.

With respect to water risk criteria, water risk criteria may correspond to different water assessment levels. For example, water assessment levels may be automatically assigned to a gas well (e.g., for different production rates) using predetermined rules that depend on water-to-gas ratios (WGR), chloride and strontium concentrations, and other risk factors. In some embodiments, water assessment levels are divided into the following categories: (1) high water risk; (2) potential water risk; (3) an acceptable water risk; and (4) a low water risk. Thus, water risk criteria may be applied to well potential values to constrain production rates with high and potential water risk levels.

Furthermore, chloride and strontium values may strongly correlate to a presence of formation water. In contrast, other contaminants produced while fracking may not provide meaningful indications of formation water. Likewise, induced damage may be minimized with proper drilling and fracking practices and cleaned up during initial testing of wells post-stimulation.

In some embodiments, the available gas supplies are determined using the following equation:

$$\text{Available Supply Rate}=\text{Well Potential}\times\text{Reservoir Pressure Criterion}\times\text{Water Risk Criterion} \quad \text{Equation 2}$$

where the available gas supplies correspond to a natural gas supply rate over time, which is a similar measurement to well potential values. The well potential values are similar to the well potential values described in Block 410 above and the accompanying description. In Equation 2, the reservoir pressure criterion and water risk criterion may be dimensionless quantities.

In some embodiments, available supply rates are determined using one or more solid production criteria. For example, a solid production criterion may correspond to a solid production constraint, where solids production prone wells are specified a maximum available supply rate based on an established solid free rate during a respective well's initial testing. As such, the solid production criteria may specify that the maximum available supply rate where the gas supply rate for a gas well does not exceed previous conditions nor solid free rates (e.g., whichever rate is lower).

In some embodiments, available supply rates are determined using one or more congestion cycling criteria. For example, some gas fields may include wells drilled in relatively close proximity to each other. To mitigate production interference or arrive at a uniform field depletion, gas wells may be grouped into different production cycles. In particular, congestion cycling may apply to wells spaced less than 1 km from each other. When defining available supply rates associated with each well, certain well groups may produce at restricted rates while other well groups (i.e., wells not affected by congestion) may produce at relatively higher production rates to compensate for one or more restrictions. Thus, a user may define restrictions and compensations for a well group dynamically. In some embodiments, congestion cycling criteria may correspond to user-specified percentages of maximum available supply rates that relax wells with nearby offset wells during one cycle in order to produce at higher percentages the next cycle. Likewise, production cycles may correspond to different months, e.g., production cycles may change on a month-to-month basis.

In some embodiments, available supply rates are determined using one or more surface facility criteria. In particular, surface facility criteria may correspond to surface facilities constraints, such that a minimum supply rate may be specified on a per well basis. For example, surface facilities constraints may be used to achieve a minimum stream velocity that prevents corrosion, water accumulation, and slugging at a well. Likewise, surface facility criteria may also include an option to shut-in a particular well with low supply priority in a production scenario. In some embodiments, a well may be shut-in in order to increase reservoir pressure and thus improve the well's well potential value. Likewise, surface facility criteria may also modify available supply rates of certain wells with high downstream pressures at high supply rates that may trigger safety alarms. Thus, a surface facility criterion may designate a well with a recommended safe gas supply rate.

In some embodiments, an available supply rate is adjusted based on gas reservoir strategic prioritization. For example, various gas plants may have predetermined streams with higher priority, which overrides an available supply rate on a stream level to satisfy one or more strategic prioritization production requirements.

In Block 430, one or more production scenarios are determined based on one or more available supply rates and one or more supply targets in accordance with one or more embodiments. For example, a production scenario may describe a production scenario rate that accounts for a distribution of various available supply rates among multiple target wells. As such, this supply distribution may be based on supply demands and gas plant allocations. For example, a final monthly production scenario rate and peak-summer-production amounts may be determined based on user-defined targets in accordance to a business plan non-associated gas (NAG) supply rate that considers reserves, supply, and demand. In some embodiments, a production scenario rate may be determined using the following equation:

$$\text{Production Scenario Rate} = \text{Available Supply Rates} \times \text{Total Supply Target}/\text{Aggregate Available Supply Rate} \qquad \text{Equation 3}$$

where the production scenario rate is the amount of gas supply produced for one or more gas plants, the available supply rates corresponds to individual available supply rates for various wells, the total supply target is the amount of gas desired for one or more gas plants, and the aggregate available supply rate corresponds to a sum of all available supply rates from the wells.

Furthermore, Equation 3 may use final maximum single wells avails or gas supplies after applying a pre-defined set of conditions associated with water risk, reservoir pressure tiers, condensate production, and congestion. Thus, Equation 3 may address gas demand dynamicity by imposing a ratio of max single wells avails to total target avails with the latter determined by gas demand. In other words, a well capable of producing more sustainable gas supplies should provide higher gas supplies than a well with a lower sustainable capability.

In some embodiments, a gas supply manager generates monthly production scenarios, peak summer production (PSP) rates. For example, the gas supply manager may perform compensation to one or more gas wells or modify a production scenario to achieve sustainable production policies. Likewise, the gas supply manager may modify productions scenarios in instantaneous manner, e.g., prior to deploying the production scenario or while the production scenario is being implemented among various gas wells and gas plants. Thus, a gas supply manager may provide interactive supply rate dynamics, where production scenarios may be generated to reduce or increase condensate-gas ratios (CGR), reduce or increase produced water (e.g., based on gas plant water handling capacity), etc.

In some embodiments, a production scenario is implemented and adjusted using various remote headers at one or more gathering systems. For example, available supply rates may correspond to different remote headers. Thus, a minimum flow rate per remote header may be enforced, e.g., using control systems or a gas supply manager, where gas wells may not exceed their previously determined max available supply rate.

In Block 440, one or more supply adjustments are determined based on one or more production scenarios in accordance with one or more embodiments. Once a production scenario is determined, a gas network may implement the production scenario using various supply adjustments. This may include modifying the supply rates at different gas wells and coordinating production constraints with gathering systems and gas plants. For example, a supply adjustment may specify which gas wells will produce in a production scenario as well as actual supply rates for each gas well.

In Block 450, one or more commands are transmitted to implement one or more supply adjustments in accordance with one or more embodiments.

In some embodiments, natural gas supplies are the focus rather than merely maximizing oil production utilized in other management networks. Thus, some embodiments use various data types and data processing techniques to tackle various supply dynamics and supply constraints. For example, water sampling data, well congestion data, and fluid stream prioritization may be used to optimize a particular production scenario. Furthermore, some embodiments provide specific well-by-well supplies based on user inputs of gas supply targets, minimum flowrates per well, congestion cycling, and production scenario capabilities. Thus, these production scenarios may prioritize certain streams or increase/reduce condensate, produced water, or solid production. Thus, some embodiments provide a gas management program to achieve various sustainability goals as well as transparency that is configurable based on changes to specific metrics.

Figure 5:
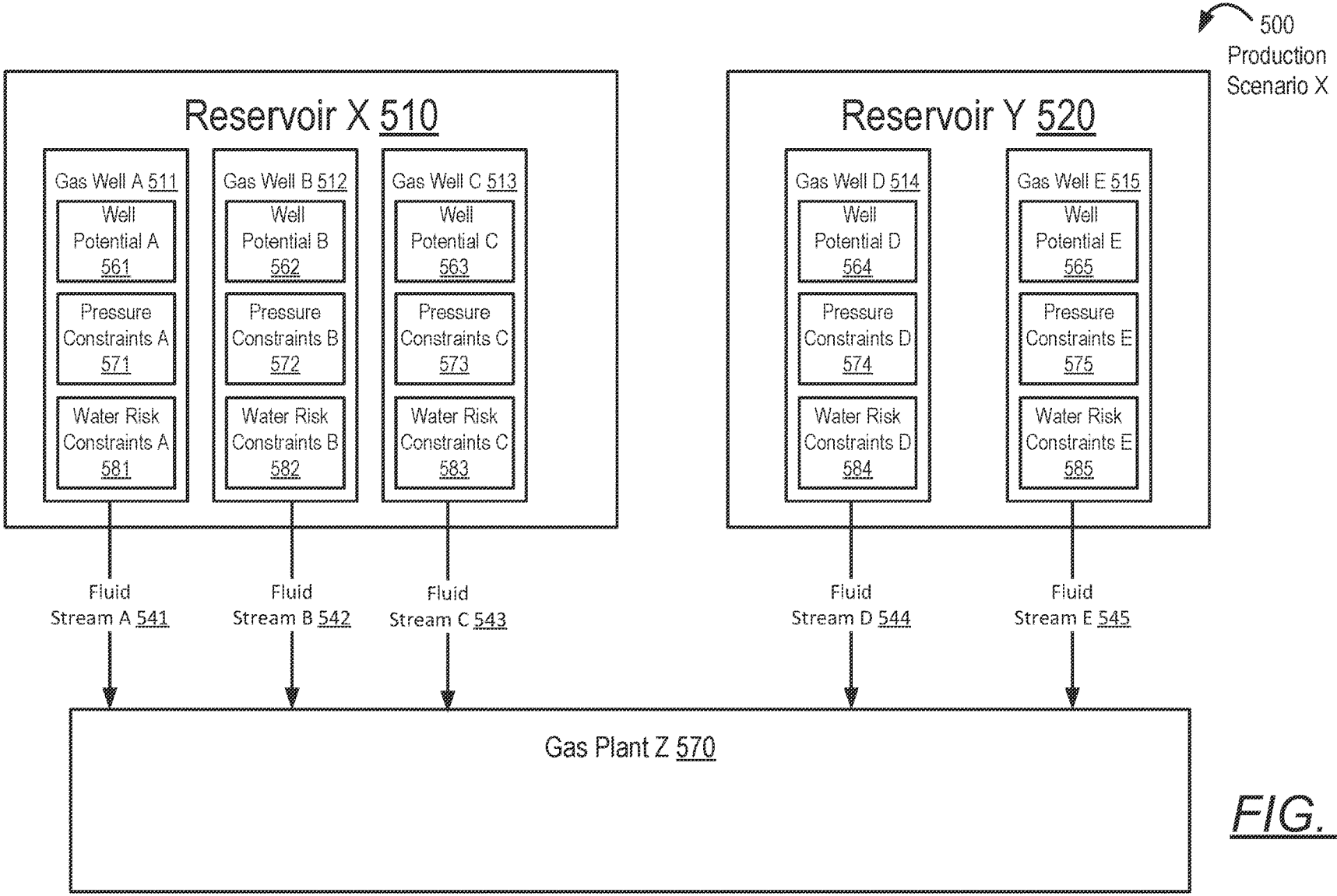
FIG. 5 shows an example in accordance with one or more embodiments.

Turning to FIG. 5, FIG. 5 provides an example of a production scenario in accordance with one or more embodiments. The following example is for explanatory purposes only and not intended to limit the scope of the disclosed technology.

Turning to FIG. 5, FIG. 5 illustrates a production scenario X (500) for supplying a gas plant Z (570) using various gas wells (i.e., gas well A (511), gas well B (512), gas well C (513), gas well D (514), gas well E (515)) from two reservoirs, i.e., reservoir X (510) and reservoir Y (520). The total available supplies for the gas plant Z (570) is based on five fluid streams from the gas wells (511, 512, 513, 514, 515), i.e., fluid stream A (541), fluid stream B (542), fluid stream C (543), fluid stream D (544), and fluid stream E (545). For example, the available supply rate from fluid stream A (541) is based on well potential A (561), pressure constraints A (571), and water risk constraints A (581). For fluid stream B (542), the available supply rate is based on well potential B (562), pressure constraints B (572), and water risk constraints B (582). For fluid stream C (543), the available supply rate is based on well potential C (563), pressure constraints A (573), and water risk constraints C (583). For fluid stream D (544), the available supply rate is based on well potential D (564), pressure constraints D (574), and water risk constraints D (584). Likewise, for fluid stream E (545), the available supply rate is based on well potential E (565), pressure constraints A (575), and water risk constraints A (585). Moreover, the production scenario X (500) is based on reservoir criteria specified by a user for determining the pressure constraints (571, 572, 573, 574, 574) and water risk criteria for determining the water risk constraints (581, 582, 583, 584, 585).

Figure 6:
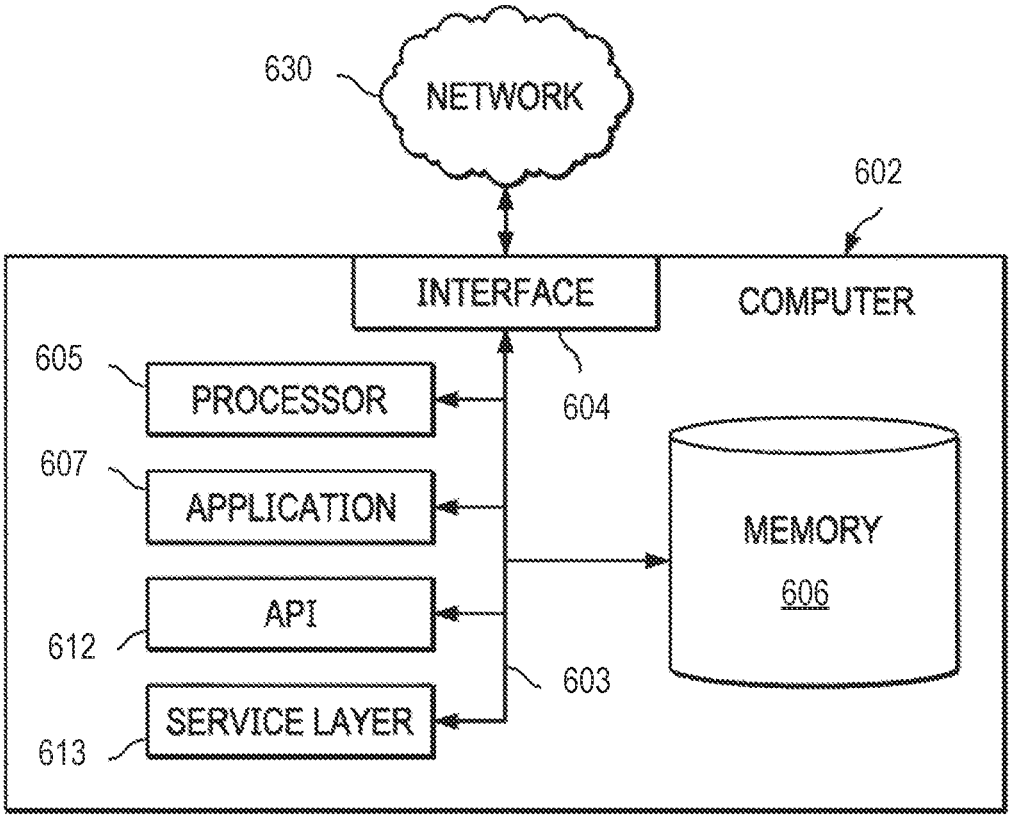
FIG. 6 shows a computer system in accordance with one or more embodiments.

Embodiments may be implemented on a computer system. FIG. 6 is a block diagram of a computer system (602) used to provide computational functionalities associated with described algorithms, methods, functions, processes, flows, and procedures as described in the instant disclosure, according to an implementation. The illustrated computer (602) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (602) may include a computer that includes an input device, such as a keypad, keyboard, touch screen, or other device that can accept user information, and an output device that conveys information associated with the operation of the computer (602), including digital data, visual, or audio information (or a combination of information), or a GUI.

The computer (602) can serve in a role as a client, network component, a server, a database or other persistency, or any other component (or a combination of roles) of a computer system for performing the subject matter described in the instant disclosure. The illustrated computer (602) is communicably coupled with a network (630). In some implementations, one or more components of the computer (602) may be configured to operate within environments, including cloud-computing-based, local, global, or other environment (or a combination of environments).

At a high level, the computer (602) is an electronic computing device operable to receive, transmit, process, store, or manage data and information associated with the described subject matter. According to some implementations, the computer (602) may also include or be communicably coupled with an application server, e-mail server, web server, caching server, streaming data server, business intelligence (BI) server, or other server (or a combination of servers).

The computer (602) can receive requests over network (630) from a client application (for example, executing on another computer (602)) and responding to the received requests by processing the said requests in an appropriate software application. In addition, requests may also be sent to the computer (602) from internal users (for example, from a command console or by other appropriate access method), external or third-parties, other automated applications, as well as any other appropriate entities, individuals, systems, or computers.

Each of the components of the computer (602) can communicate using a system bus (603). In some implementations, any or all of the components of the computer (602), both hardware or software (or a combination of hardware and software), may interface with each other or the interface (604) (or a combination of both) over the system bus (603) using an application programming interface (API) (612) or a service layer (613) (or a combination of the API (612) and service layer (613). The API (612) may include specifications for routines, data structures, and object classes. The API (612) may be either computer-language independent or dependent and refer to a complete interface, a single function, or even a set of APIs. The service layer (613) provides software services to the computer (602) or other components (whether or not illustrated) that are communicably coupled to the computer (602). The functionality of the computer (602) may be accessible for all service consumers using this service layer. Software services, such as those provided by the service layer (613), provide reusable, defined business functionalities through a defined interface. For example, the interface may be software written in JAVA, C++, or other suitable language providing data in extensible markup language (XML) format or other suitable format. While illustrated as an integrated component of the computer (602), alternative implementations may illustrate the API (612) or the service layer (613) as stand-alone components in relation to other components of the computer (602) or other components (whether or not illustrated) that are communicably coupled to the computer (602). Moreover, any or all parts of the API (612) or the service layer (613) may be implemented as child or sub-modules of another software module, enterprise application, or hardware module without departing from the scope of this disclosure.

The computer (602) includes an interface (604). Although illustrated as a single interface (604) in FIG. 6, two or more interfaces (604) may be used according to particular needs, desires, or particular implementations of the computer (602). The interface (604) is used by the computer (602) for communicating with other systems in a distributed environment that are connected to the network (630). Generally, the interface (604 includes logic encoded in software or hardware (or a combination of software and hardware) and operable to communicate with the network (630). More specifically, the interface (604) may include software supporting one or more communication protocols associated with communications such that the network (630) or interface's hardware is operable to communicate physical signals within and outside of the illustrated computer (602).

The computer (602) includes at least one computer processor (605). Although illustrated as a single computer processor (605) in FIG. 6, two or more processors may be used according to particular needs, desires, or particular implementations of the computer (602). Generally, the computer processor (605) executes instructions and manipulates data to perform the operations of the computer (602) and any algorithms, methods, functions, processes, flows, and procedures as described in the instant disclosure.

The computer (602) also includes a memory (606) that holds data for the computer (602) or other components (or a combination of both) that can be connected to the network (630). For example, memory (606) can be a database storing data consistent with this disclosure. Although illustrated as a single memory (606) in FIG. 6, two or more memories may be used according to particular needs, desires, or particular implementations of the computer (602) and the described functionality. While memory (606) is illustrated as an integral component of the computer (602), in alternative implementations, memory (606) can be external to the computer (602).

The application (607) is an algorithmic software engine providing functionality according to particular needs, desires, or particular implementations of the computer (602), particularly with respect to functionality described in this disclosure. For example, application (607) can serve as one or more components, modules, applications, etc. Further, although illustrated as a single application (607), the application (607) may be implemented as multiple applications (607) on the computer (602). In addition, although illustrated as integral to the computer (602), in alternative implementations, the application (607) can be external to the computer (602).

There may be any number of computers (602) associated with, or external to, a computer system containing computer (602), each computer (602) communicating over network (630). Further, the term "client," "user," and other appropriate terminology may be used interchangeably as appropriate without departing from the scope of this disclosure. Moreover, this disclosure contemplates that many users may use one computer (602), or that one user may use multiple computers (602).

In some embodiments, the computer (602) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

obtaining, by a computer processor, first gas well data regarding a first plurality of gas wells;

determining, by the computer processor, a first plurality of well potential values for the first plurality of gas wells based on the first gas well data and a first predetermined production period;

determining, by the computer processor and based on the first plurality of well potential values, a reservoir pressure criterion, and a water risk criterion, an available supply rate for a respective gas well among the first plurality of gas wells;

determining, by the computer processor, a first production scenario based on the available supply rate and a first supply target; and transmitting, by the computer processor, a command that implements a gas supply adjustment at one or more gas plants based on the production scenario, wherein the first gas well data comprises flowing wellhead pressure (FWHP) data that is acquired using at least one pressure sensor in at least one well-surface system, and wherein the reservoir pressure criterion is determined using the FWHP data and a plurality of predetermined reservoir pressure tiers that describe different pressure conditions of a reservoir.

2. The method of claim 1, wherein the command is transmitted to a gathering system, and wherein the command adjusts a plurality of gas supply rates associated with a plurality of remote headers at the gathering system.

3. The method of claim 1, wherein the first gas well data comprises tested gas rate data and productivity index values for one or more geological regions coupled to the first plurality of gas wells, wherein the tested gas rate data corresponds to a maximum gas supply rate at the respective gas well, and wherein the first plurality of well potential values are a function of the tested gas rate data, the FWHP data, and the productivity index values.

4. The method of claim 1, wherein the first gas well data comprises water sampling data that is acquired at the respective gas well, wherein the water risk criterion is determined using the water sampling data and a plurality of water assessment levels that describe an amount of risk to a predetermined water supply by produced water from a gas plant, and wherein the plurality of water assessment levels are based on one or more thresholds of predetermined chemical concentrations.

5. The method of claim 1, wherein the plurality of predetermined reservoir pressure tiers comprise a first reservoir pressure tier, a second reservoir pressure tier, and a third reservoir pressure tier, and wherein the first reservoir pressure tier corresponds to a shut-in well where the shut-in well increases reservoir pressure during the first predetermined production period, wherein the second reservoir pressure tier corresponds to a first gas well that produces a maximum gas supply rate for the first gas well, and wherein the third reservoir pressure tier corresponds to a second gas well that produces a gas supply rate that is less than a maximum gas supply rate for the second gas well.

6. The method of claim 1, further comprising:

obtaining congestion cycling data regarding a second plurality of gas wells within a predetermined proximity and coupled to a reservoir; and determining, using a congestion cycling criterion and the congestion cycling data, a first subset of gas wells and a second subset of gas wells among the second plurality of gas wells, wherein the first subset of gas wells produces a restricted gas rate based on the congestion cycling criterion, and wherein the second subset of gas wells produces an unrestricted gas rate based on the congestion cycling criterion.

7. The method of claim 1, further comprising:

determining, using a surface facility criterion and second gas well data, a minimum gas supply rate for a gas well, wherein the minimum gas supply rate corresponds to a minimum stream velocity from the gas well that prevents corrosion at the gas well.

8. The method of claim 1, further comprising:

obtaining, in response to a user selection within a graphical user interface in a user device, a request to determine a second production scenario for a second predetermined production period and the first plurality of gas wells;

obtaining, in real-time, second gas well data regarding the first plurality of gas wells; and determining, in real-time, the second production scenario using the second gas well data, a second plurality of well potential values, a second reservoir pressure criterion, and a second water risk criterion, and a second supply target, wherein the second predetermined production period, the second reservoir pressure criterion, the second water risk criterion, and the second supply target correspond to the user selection.

9. The method of claim 1, wherein the first supply target corresponds to a predicted amount of gas supply demand at the one or more gas plants.

10. A system, comprising:

a first plurality of gas wells comprising a plurality of pressure sensors configured to detect flowing wellhead pressure (FWHP) data;

a gathering system coupled to the first plurality of gas wells, the gathering system comprising a plurality of remote headers that are configured for controlling streams from the first plurality of gas wells;

a gas supply manager comprising a computer processor and coupled to the first plurality of gas wells and the gathering system, wherein the gas supply manager comprises functionality for:

obtaining first gas well data regarding the first plurality of gas wells;

determining a plurality of well potential values for the first plurality of gas wells based on the first gas well data and a predetermined production period;

determining, based on the plurality of well potential values, a reservoir pressure criterion, and a water risk criterion, an available supply rate for a respective gas well among the first plurality of gas wells;

determining a first production scenario based on the available supply rate and a first supply target; and transmitting a command that implements a gas supply adjustment at one or more gas plants based on the first production scenario; and a gas processing plant coupled to the gas supply manager and the gathering system, wherein the gas processing plant is configured to transmit gas plant data to the gas supply manager, and wherein the gas plant data comprises supply demand data regarding demand for condensate or liquid natural gas at the gas processing plant.

11. The system of claim 10, further comprising:

a user device coupled to the gas supply manager, wherein the user device is configured to obtain a user selection within a graphical user interface regarding the reservoir pressure criterion and the water risk criterion to produce an adjusted reservoir pressure criterion and an adjusted water risk criterion, and wherein the gas supply manager determines a second production scenario based on the adjusted reservoir pressure criterion and the adjusted water risk criterion.

12. The system of claim 10, wherein the command is transmitted to a gathering system, and wherein the command adjusts a plurality of gas supply rates associated with the plurality of remote headers.

13. The system of claim 10, wherein the gas supply manager further comprises functionality for:

obtaining congestion cycling data regarding a second plurality of gas wells within a predetermined proximity and coupled to a reservoir; and determining, using a congestion cycling criterion and the congestion cycling data, a first subset of gas wells and a second subset of gas wells among the second plurality of gas wells, wherein the first subset of gas wells produces a restricted gas rate based on the congestion cycling criterion, and wherein the second subset of gas wells produces an unrestricted gas rate based on the congestion cycling criterion.

14. The system of claim 10, wherein the gas supply manager further comprises functionality for:

determining, using a surface facility criterion and second gas well data, a minimum gas supply rate for a gas well, wherein the minimum gas supply rate corresponds to a minimum stream velocity from the gas well that prevents corrosion at the gas well.

15. A non-transitory computer readable medium storing instructions executable by a computer processor, the instructions comprising functionality for:

obtaining gas well data regarding a plurality of gas wells;

determining a plurality of well potential values for the plurality of gas wells based on the gas well data and a predetermined production period;

determining, based on the plurality of well potential values, a reservoir pressure criterion and a water risk criterion, an available supply rate for a respective gas well among the plurality of gas wells;

determining a production scenario based on the available supply rate and a first supply target; and transmitting a command that implements a gas supply adjustment at one or more gas plants based on the production scenario, wherein the first gas well data comprises tested gas rate data, flowing wellhead pressure (FWHP) data, and productivity index values for one or more geological regions coupled to the plurality of gas wells, wherein the tested gas rate data corresponds to a maximum gas supply rate at the respective gas well, and wherein the plurality of well potential values are a function of the tested gas rate data, the FWHP data, and the productivity index values.

16. The non-transitory computer readable medium of claim 15, wherein the first gas well data comprises water sampling data that is acquired at the respective gas well, wherein the water risk criterion is determined using the water sampling data and a plurality of water assessment values that describe an amount of risk to a predetermined water supply by produced water from a gas plant, and wherein the plurality of water assessment levels are based on one or more thresholds of predetermined chemical concentrations.

17. The non-transitory computer readable medium of claim 15, wherein the FWHP data is acquired using at least one pressure sensor in at least one well-surface system, and wherein the reservoir pressure criterion is determined using the FWHP data and a plurality of predetermined reservoir pressure tiers that describe different pressure conditions of a reservoir.

* * * * *